US006098553A

United States Patent [19]

Oksanen et al.

[11] Patent Number: 6,098,553

[45] Date of Patent: Aug. 8, 2000

[54] ARRANGEMENT FOR CONVERTING A CONVENTIONAL OIL BOILER TO A BOILER WITH MOIST, GRANULAR AND SOLID FUEL

[75] Inventors: Mauno Oksanen; Markku Miettinen; Markku Pyykkönen; Kari Pajunen, all of Jyväskylä, Finland

[73] Assignee: Vapo Oy, Jyvaskyla, Finland

[21] Appl. No.: 09/280,220

[22] Filed: Mar. 29, 1999

[51] Int. Cl.[7] ..... F23G 5/04

[52] U.S. Cl. ..... 110/224; 110/221; 110/245; 122/4 D

[58] Field of Search ..... 110/221, 224, 110/227, 228, 245; 122/4 D

[56] References Cited

U.S. PATENT DOCUMENTS

| | | | |
|---|---|---|---|
| 1,578,181 | 3/1926 | Balmer | 110/224 |
| 2,271,157 | 1/1942 | Badenhausen | 110/228 |
| 2,939,411 | 6/1960 | Priestley | 110/28 |
| 4,465,022 | 8/1984 | Virr | 122/4 D |
| 4,530,169 | 7/1985 | Okawara | 34/582 |
| 4,938,155 | 7/1990 | Williams | 110/345 |
| 5,027,893 | 7/1991 | Cetinkaya et al. | 165/104.18 |
| 5,231,936 | 8/1993 | Kikuchi et al. | 110/224 |
| 5,302,352 | 4/1994 | Rahlwes | 110/245 |
| 5,429,059 | 7/1995 | Wagoner et al. | 110/234 |

FOREIGN PATENT DOCUMENTS

| | | | |
|---|---|---|---|
| 423 400 A1 | 10/1989 | European Pat. Off. | F23G 5/40 |
| 0902235A2 | 3/1999 | European Pat. Off. . | |
| 42 14 496 A1 | 11/1993 | Germany | F23K 1/04 |
| 97/12177 | 4/1997 | WIPO . | |

OTHER PUBLICATIONS

Abstract of E.I. Conference No. EIP95092854665 "Present State of Regenerative CFB Heat Exchanger Development" by Ruottu, Seppo K.: Sarkomaa, Pertti J.

*Primary Examiner*—Denise L. Ferensic
*Assistant Examiner*—Jiping Lu
*Attorney, Agent, or Firm*—Fildes & Outland, P.C.

[57] ABSTRACT

An arrangement for converting a conventional oil boiler to a boiler with moist, granular and solid fuel, utilizes a fuel combustion gas dryer connected to the combustion gas line of the boiler, and a solid fuel combustion device to replace the oil burner. The combustion gas dryer is a so-called circulating fluidized bed (CFB) dryer together with a particle separator and a combustion gas center tap has been fitted into the oil boiler, through which center tap hot combustion gas has been set to be mixed with combustion gases of the normal outlet in the desired proportion in order to regulate the temperature of the drying gas of the dryer. The combustion devices may include a cyclone burner.

10 Claims, 3 Drawing Sheets

ARRANGEMENT FOR CONVERTING A CONVENTIONAL OIL BOILER TO A BOILER WITH MOIST, GRANULAR AND SOLID FUEL

FIELD OF THE INVENTION

This invention relates to an arrangement for converting a conventional oil boiler to a boiler with moist, granular and solid fuel, which arrangement uses a fuel combustion gas dryer connected to the boiler's combustion gas line and a combustion device for solid fuel to replace the oil burner. Solid fuel means here mainly sawdust, peat and other biological fuel.

BACKGROUND OF THE INVENTION

Conventional heating, warm water and steam boilers which use oil are badly adaptable to solid fuel. Different pre-burner constructions are known, but they have several disadvantages. Full effect is normally not achieved, because the properties of fuel gases differ considerably from the measured values. The combustion gas temperature of a pre-burner that burns moist fuel stays much lower than that of oil heating which has been used as the standard measure. The share of water vapor is considerably greater than that measured. The situation will improve essentially if the moist fuel is dried with combustion gas before it is burnt. Thereby, the combustion temperature and together with it the combustion capacity will rise. However, no practical and economical way to convert a 0.5–10 MW oil boiler of low effect to a boiler with solid fuel has been found. It is difficult to make a fuel dryer work at the end of a conventional oil boiler, because the final temperature of combustion gas is too low. The aforementioned pre-burner solutions are quite awkward and expensive. The efficiency usually stays low and the greatest combustion capacity remains much lower than the nominal capacity of an oil boiler. Dust combustion does not normally come into question because it is so expensive.

SUMMARY OF THE INVENTION

The object of the invention is to achieve a new sort of arrangement for converting a conventional oil boiler to a boiler with moist, granular and solid fuel, which gives a good efficiency and almost all the effect of the converted boiler. The characteristic features of the invention are presented in the accompanying patent claims. This invention makes use of solutions, known as such, in the way of a new combination, whereby the oil boiler can be made to function close to the optimal circumstances in a more simple way than before. Conventional oil boilers usually have several consecutive heat surfaces after the furnace. A center tap can usually be installed somewhere in between these or even behind the furnace, for example in the maintenance hatch, whereby hot combustion gas is mixed in the desired proportion with cold combustion gases in order to obtain the desired temperature, 200–300° C. In this case, the dryer can be a dryer, known in itself, which produces fuel with a moisture level of 10–15% for example to be used with a CMR burner.

An especially advantageous application due to its simplicity can be obtained by using a CMR burner according to PCT publication WO 97/12177. CMR (Chemi mechanical reactor) is most suitable to replace an oil burner, because it gives a short flame length also with coarse fuel. The melt cyclone burners that are known are more complex and more expensive even if they could as such be used in this arrangement.

These and other features and advantages of the invention will be more fully understood from the following detailed description of the invention, which show some of the applications of the invention, taken together with the accompanying drawings.

DETAILED DESCRIPTION OF THE INVENTION

Figure 1:
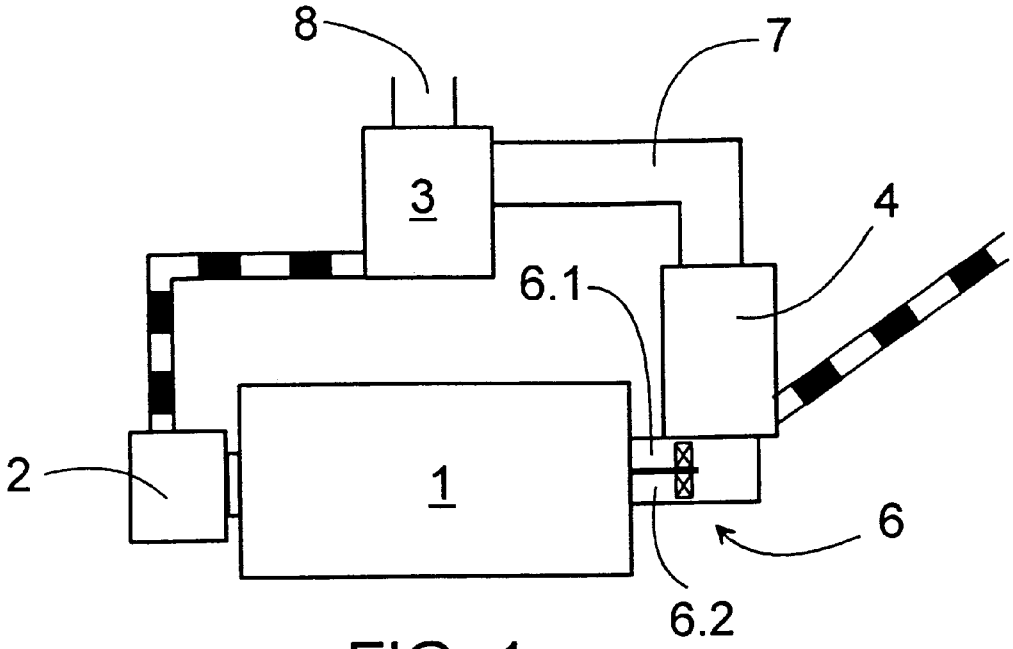
FIG. 1 is a schematic view showing a boiler arrangement which uses a CMR burner constructed in accordance with the present invention.

Referring now to the drawings in detail, an application of the invention includes an oil boiler 1, a CMR burner 2, and a fuel dryer 4 attached to a combustion gas line or duct 6. Dryer 4 is connected with particle separator 3, in FIG. 1. The structure of the CMR burner is explained in more detail in patent publication No. 98854. In the publication, a selective delay is created so that the coarse particles stay in the swirl chamber for a longer time and until they are smaller than of boundary size. The length of the flame can be made short by letting out particles from the burner that are smaller than of boundary size.

Certain dryers have been presented in Finnish Patent Application Nos. 852594 and 903097, and in reference No. 04252654 of the Compendex database, Ruottu, Seppo; Sarkomaa, Pertti: "Present state of regenerative CFB heat exchanger development", Proceedings of the International Conference on Fluidized bed Combustion, ASME, New York, N.Y., USA, Vol 1, pp. 419–422, 1995. The main principle is to circulate the fuel to be dried with drying air until the characteristic weight of the fuel falls below a level that it will, due to its lightness, leave the separation cyclone together with the outflow, after which the dry fuel is separated from the combustion gases in its own separation cyclone.

Referring to FIG. 1, even a simple dryer can be made to function quite effectively when a combustion gas center tap is fitted to the oil boiler, the duct of which has been marked with reference number 6.2, when the usual exit duct has been marked with reference number 6.1. These ducts include adjustment valves by which the hot (200–700° C.) and cold (100–150° C.) combustion gases are mixed together in order to adjust the temperature of the drying gas. When the humidity of the fuel, for example sawdust or peat, is 45–55%, the temperature of the combustion gas which is fed onto the dryer 4 is 200–300° C. and the amount of heat is enough to dry the amount of fuel of corresponding combustion capacity to a level of humidity of 10–15% with a moderate air surplus. After separator 3, the temperature of the combustion gases in departing duct 8 is only 65–70° C. which gives the whole arrangement a very good total efficiency (even 95%) despite the center tap of the boiler. All of the outer components of boiler 1 of the arrangement, the circulating fluidized bed (CFB) dryer 4, the particle separator 3 and the CMR burner 2 are quite simple as to their structure. Especially the upper part of dryer 4 and the particle separator 3 must be made out of stainless steel or out of another material that can resist corrosion, because the combustion gases are close to dewpoint.

Figure 2:
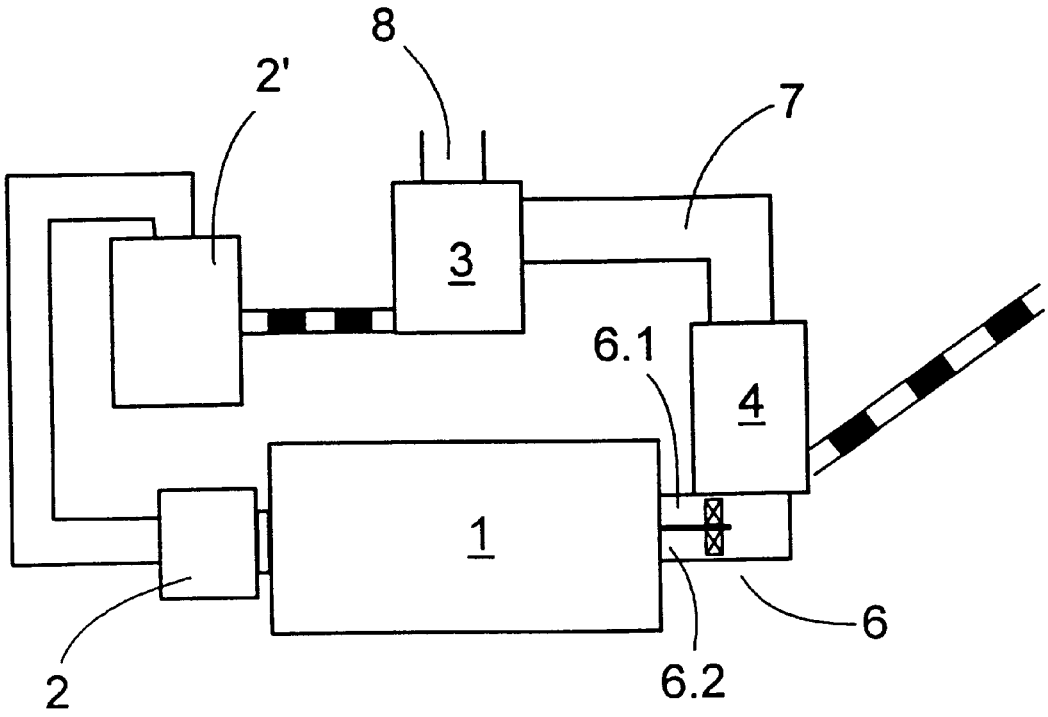
FIG. 2 is a schematic view showing a boiler arrangement which uses a carburetor and a gas burner.

FIG. 2 presents an adaptation of the application illustrated in FIG. 1. Therein, a combination of carburetor 2' and gas burner 2 are used instead of the CMR burner in FIG. 1. The structure is more complex than that presented above, but still otherwise more advantageous than before. Also here, a great combustion capacity is obtained with dry fuel, when the water that is included in the oil does not circulate through the boiler.

Figure 3:
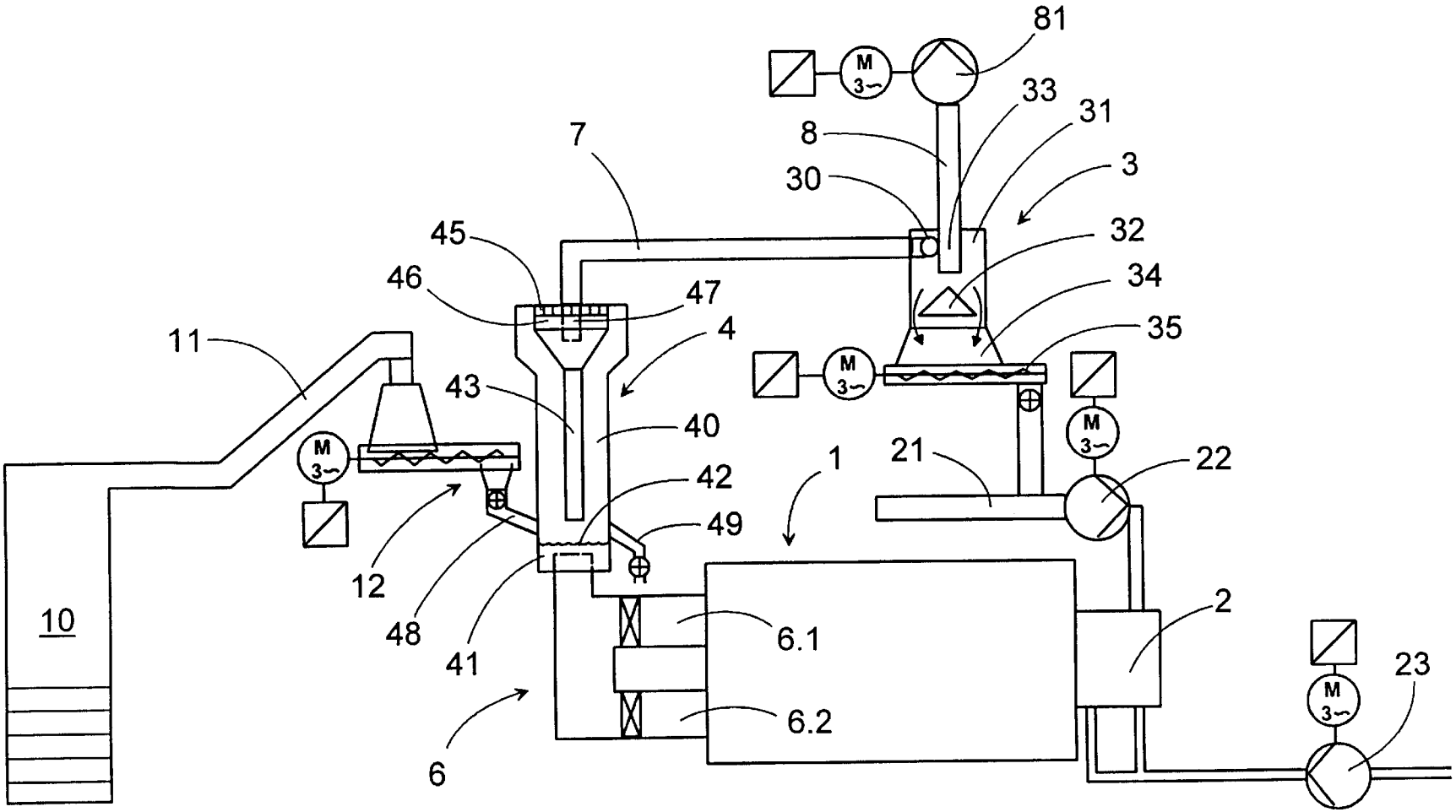
FIG. 3 is a schematic view illustrating the arrangement of FIG. 1 in more detail.

FIG. 3 illustrates the principle of the connection in FIG. 1 in more detail. The inner structures of dryer 4 and of particle separator 3 are presented schematically. Their most important help devices, as those of CMR burner 2 are further presented.

A conventional oil boiler 1, of the flue—fire-tube boiler type, is equipped with a CMR burner 2 instead of an oil boiler. Its fuel supply is explained later. The boiler can also be a plate or pipe boiler. In addition to the actual combustion gas exit 6.1, the boiler has been fitted with a center tap 6.2 in order to catch the hot combustion gas. The capacity of the boiler is 80–90% of its nominal capacity with oil. The temperature in the combustion gas duct 6 that leads to dryer 4 is the above mentioned 200–300° C.

The moist fuel is transferred from storage silo 10 by transporter 11 via sluice feeder 12 to feed connection 48 of the dryer.

The main parts of dryer 4 are: dryer pipe 40, air division chamber 41, an air division plate 42 upon it, separator cyclone 46, which has on its upper side the tangential inlets 45, wastepipe 43 and outlet connection 49. The fuel is fed through the aforementioned feed connection 48 onto the air division plate 42. In case big lumps need to be removed, this is done through outlet connection 49. When the fuel dries, it follows the strong flow upwards, arriving via the tangential feeding inlets 45 to cyclone 46, in which the heavier moist mass falls through wastepipe 43 back to air division plate 42, and the dry fuel that has circulated several times, and which is light, is let out through outlet 47.

Outlet 47 is connected to transport duct 7 which transports the fuel-air mixture to particle separator 3 which here is formed out of cyclone 31, built on top of feeding silo 34. Intake connection 30 is tangential, bringing about the strong vortex that is required by the disparity. The bottom of cyclone 31 is slightly smaller in diameter than cone 32, the point of which shows upwards. The fuel particles flow along the cone surface down to the sides and further down to feeding silo 34. Screw transporter 35 that is included in the silo transports together with its sluice feeder the dry fuel to combustion air suction duct 21 of CMR burner 2. Blower 22 sucks the fuel up with the carrying airflow, and feeds it to the burner. The secondary airflow is produced with the help of blower 23.

In the CMR burner, the fuel is set to be fed together with a sub-stoichiometric primary air amount into the swirl chamber and the secondary airflow is set to be fed in a concentric whirl into the swirl chamber, around the outflow. The rate of air is regulated with nominal effect with the help of secondary airflow to the area of 1.2–1.35.

Figure 4:
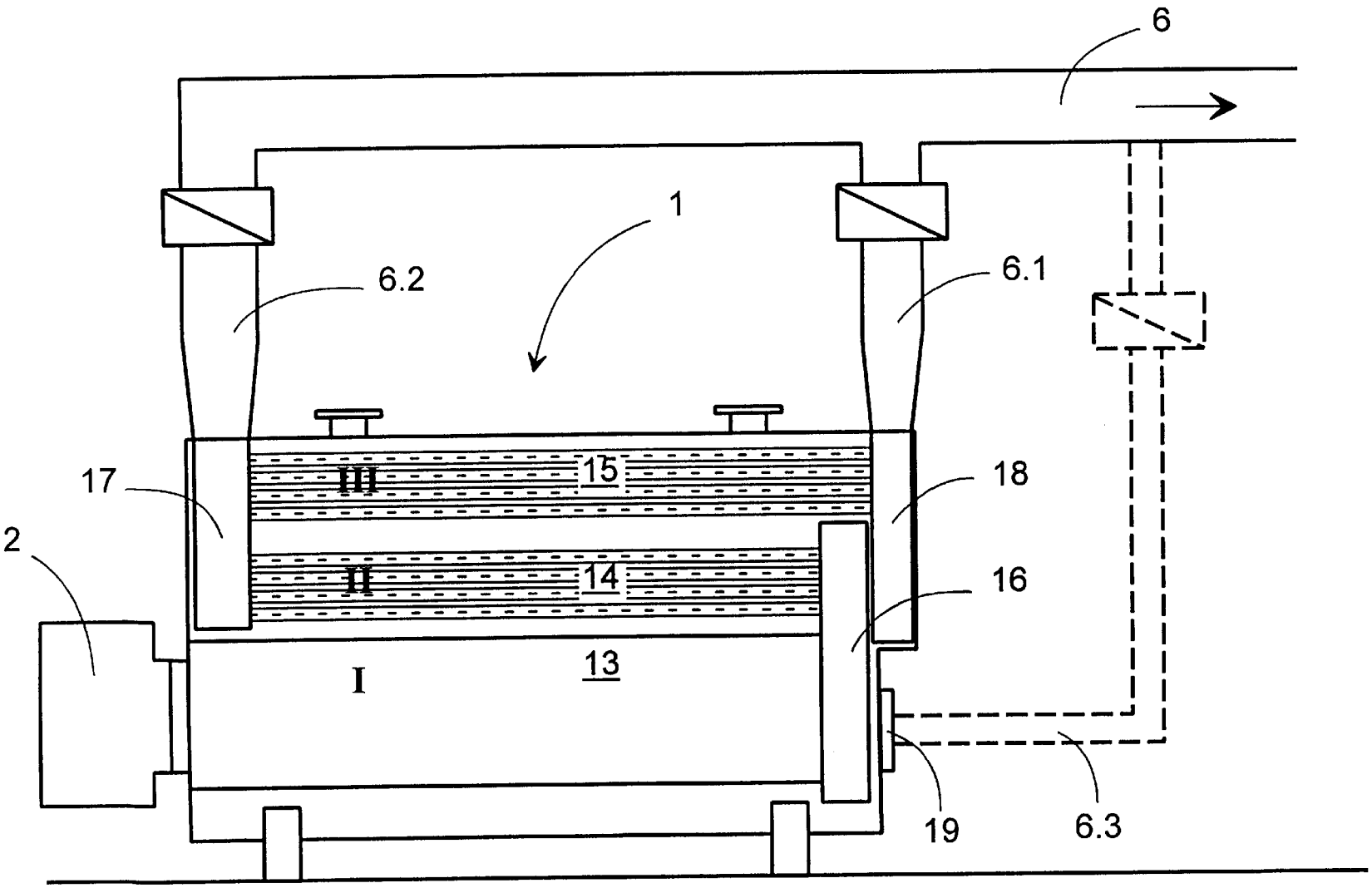
FIG. 4 is a schematic view showing a combustion gas and center tap connection in a traditional flue—fire-tube boiler.

FIG. 4 illustrates an arrangement in connection with a conventional oil boiler in detail. The oil boiler is marked with reference number 1 and it is of the flue—fire-tube boiler type. It has three passes, I, II and III, which have also been marked with reference numbers 13, 14 and 15. The first pass is formed by flue 13 itself. The second and third passes are formed by the fire-tubes. CMR burner 2 blows the hot combustion gases to flue 13. Return chamber 16 is placed at the other end, and it leads the combustion gases to the second pass 14. At the end of this, between the second pass 14 and the third pass 15, there is another return chamber 17. At the end of the third chamber there is an outlet chamber 18, onto which the normal combustion gas outlet connection has been fitted. Chambers 16, 17 and 18 are usually either provided with a maintenance hatch or they can be opened so that the fire surfaces can be cleaned.

The above mentioned normal combustion gas duct 6.1 is connected to outlet chamber 18 connection. It is essential in relation to this invention that a center tap 6.2 is made to the conventional boiler, which center tap is connected to some center chamber, here chamber 17. It would alternatively be possible to connect the center tap also to chamber 16 by duct 6.3 which has been drawn by broken lines in the figure, for example through maintenance hatch 19, if a higher center tap temperature were needed. Practical experiments have shown that the temperature after the second pass has been sufficient and that the required 200–300° C. temperature is reached in all load circumstances before the dryer. Some other oil boiler might require an earlier center tap.

The arrangement can be fitted with a scrubber in order to further enhance the combustion gases or with a heat recovery unit in order to advance the efficiency.

Although the invention has been described by reference to specific embodiments, it should be understood that numerous changes may be made within the spirit and scope of the inventive concepts described. Accordingly, it is intended that the invention not be limited to the described embodiments, but that it have the full scope defined by the language of the following claims.

What is claimed is:

1. An arrangement for converting a conventional oil boiler having a normal combustion gas exit duct to a boiler that uses moist, granular and solid fuel, said arrangement comprising:

a circulating fluidized bed dryer for receiving and drying the moist, granular and solid fuel;

a particle separator connected to said dryer for separating solid fuel from combustion gases;

a combustion device connected to said particle separator, said combustion device including one of a cyclone burner or a carburetor/gas burner combination;

a combustion gas center tap including a second duct fittable into the oil boiler for releasing hot combustion gases from a center chamber of the boiler; and a combustion gas line connecting the normal combustion gas exit duct and the second duct and connected to the dryer to provide drying gases thereto, said combustion gas line having two valves for regulating gas flows from the normal exit duct and the second duct in a desired proportion to adjust the temperature of the mixed gas supplied to the dryer.

2. An arrangement as in claim 1 wherein the temperature of the combustion gases before the dryer is in the range of 200–300° C. and after the separator in the range of 60–80° C. when the air surplus is 1.2–1.35 at nominal effect.

3. An arrangement as in claim 2 wherein the particle separator is a cyclone integrated with a top of a fuel silo, said separator being defined by a cylinder having a bottom and an upwardly pointing small cone centrally located at said bottom, whereby the separated fuel flows in between the lower edge of the cone and the cylinder to reach the fuel silo.

4. An arrangement as in claim 2 wherein the dryer includes a vertical dryer pipe having an upper part and a lower part, an air division chamber and an air division plate located at the lower part and a separating cyclone centrally located at the upper part, said separating cyclone having a central wastepipe downwardly extending close to the air division plate.

5. An arrangement as in claim 2 wherein the cyclone burner is a chemimechanical-reactor burner having a swirl chamber wherein the fuel is fed together with a sub-stoichiometric primary air amount into the swirl chamber and the secondary airflow is fed in a concentric whirl around an outflow of the swirl chamber.

6. An arrangement as in claim 2 wherein the oil boiler is a flue-fire-tube boiler having at least one center chamber and said center tap is connected to said at least one said center chamber.

7. An arrangement as in claim 1 wherein the particle separator is a cyclone integrated with a top of a fuel silo, said separator being defined by a cylinder having a bottom and an upwardly pointing small cone centrally located at said bottom, whereby the separated fuel flows in between a lower edge of the cone and the cylinder to reach the fuel silo.

8. An arrangement as in claim 1 wherein the dryer includes a vertical dryer pipe having an upper part and a lower part, an air division chamber and an air division plate located at the lower part and a separating cyclone centrally located at the upper part, said separating cyclone having a central wastepipe downwardly extending close to the air division plate.

9. An arrangement as in claim 1 wherein the cyclone burner is a chemimechanical-reactor burner having a swirl chamber wherein the fuel is fed together with a sub-stoichiometric primary air amount into the swirl chamber and a secondary airflow is fed in a concentric whirl around an outflow of the swirl chamber.

10. An arrangement as in claim 1 wherein the oil boiler is a flue-fire-tube boiler having at least one center chamber and said center tap is connected to said at least one said center chamber.

* * * * *